US006668495B1

(12) United States Patent
Prince

(10) Patent No.: US 6,668,495 B1
(45) Date of Patent: Dec. 30, 2003

(54) VARIABLE LOAD CAPACITY AND AESTHETICALLY ENHANCED CONSTRUCTION COMPONENTS FOR PATIO ENCLOSURES

(76) Inventor: Richard T. Prince, 11211 84th Ct. Nort, West Palm Beach, FL (US) 33412

( * ) Notice: Subject to any disclaimer, the term of this patent is extended or adjusted under 35 U.S.C. 154(b) by 0 days.

(21) Appl. No.: 10/189,461

(22) Filed: Jul. 8, 2002

Related U.S. Application Data

(63) Continuation-in-part of application No. 09/949,822, filed on Sep. 12, 2001, now Pat. No. 6,601,362.

(51) Int. Cl.[7] ..... E04H 15/00; E04C 3/00

(52) U.S. Cl. ..... 52/63; 52/222; 52/656.1; 52/732.1; 52/737.1; 160/391

(58) Field of Search ..... 52/63, 222, 273, 52/730.4, 730.5, 731.3, 731.4, 731.2, 732.1, 732.2, 732.3, 737.6, 737.1, DIG. 8, DIG. 17, 656.7, 656.1, 648.1; 47/17; 160/371, 391; 135/121, 908

(56) References Cited

U.S. PATENT DOCUMENTS 2,837,153 A * 6/1958 Brown et al. ..... 160/371
3,143,165 A * 8/1964 Lewis et al. ..... 160/394
3,222,841 A * 12/1965 Lipof ..... 52/731.5
3,382,639 A * 5/1968 Smith et al. ..... 52/731.3
4,057,941 A * 11/1977 Schwartz ..... 52/63
4,084,360 A * 4/1978 Reckson ..... 52/63
4,188,764 A * 2/1980 Gode ..... 52/481.2
4,261,144 A * 4/1981 Rizzo ..... 52/63
4,274,234 A * 6/1981 Abell ..... 52/63
4,887,626 A * 12/1989 Dalo et al. ..... 135/119
5,046,546 A * 9/1991 Benedyk et al. ..... 160/371
5,088,252 A * 2/1992 Antekeier ..... 52/287.1
5,802,800 A * 9/1998 Meyers ..... 52/731.2
5,904,022 A * 5/1999 Zadok ..... 52/650.1
5,910,084 A * 6/1999 Koike et al. ..... 52/204.1
6,192,643 B1 * 2/2001 Zadok ..... 52/648.1
6,338,226 B1 * 1/2002 Gauthier et al. ..... 52/63
6,385,941 B1 * 5/2002 Power et al. ..... 52/731.3

* cited by examiner

*Primary Examiner*—Brian E. Glessner
(74) *Attorney, Agent, or Firm*—C. J. Husar, Esq.

(57) ABSTRACT

A screened patio enclosure is provided with primary and secondary structural members for retaining screening fabric and decorative inserts that are available in a variety of pleasing colors and patterns thus improving the aesthetic appearance of the interior of the enclosure. Additionally, the primary members include integral recesses for receiving load carrying insert members thus allowing the load capacity of the primary structural members to be increased incrementally by varying the number of metallic inserts added to the primary structural members. The primary structural members include post/columns and beams while the secondary structural members include horizontal and diagonal purlins and base anchoring members.

14 Claims, 8 Drawing Sheets

VARIABLE LOAD CAPACITY AND AESTHETICALLY ENHANCED CONSTRUCTION COMPONENTS FOR PATIO ENCLOSURES

CROSS-REFERENCE TO RELATED APPLICATION

This application is a continuation-in-part of application Ser. No. 09/949,822, filed on Sep. 12, 2001 and entitled, VARIABLE LOAD CAPACITY CONSTRUCTION COMPONENTS FOR PATIO POOL ENCLOSURES, by the same inventor as the subject application now U.S. Pat. No. 6,601,362.

BACKGROUND OF THE INVENTION

The present invention relates to screened patio enclosures utilizing construction components such as beams and posts/columns. More specifically, it relates to beams and posts/columns which have a variable load capacity and includes decorative inserts for the primary and secondary construction components. The invention finds particular use in the construction of screened porch and patio/pool enclosures to form the frame work for the subsequently added screening. As one can imagine, a variety of beam and post/column capacities are required depending on the size of the particular job, and aesthetically enhanced, would be a desirable feature in what has been until now, plain colored metal, typically white or bronze.

The popularity of all weather, almost invisible fiberglass screened porch and patio enclosures has been rapidly increasing throughout the country, especially in the south, southeast, southwest and lower west coastal areas of the country. These enclosures find their popularity in the fact that they are very effective in keeping insects out while allowing the sunlight and breezes in, which is conducive to eating or partying outdoors in peace, protected from flies, mosquitoes and other insects.

Furthermore, these enclosures prevent the accumulation of leaves and debris, thus reducing maintenance time and cost, create a safe play area for children and provide security from unauthorized entry to your patio/pool area by unsupervised children. In addition, they enhance the value of your property by providing more useful living space at a fraction of the cost of a room addition.

As one would expect, these enclosures come in a wide variety of sizes. Some enclose only porch areas, others pool and patio areas, while still others are sufficiently large to enclose the immediate exterior of a multi-level home with a balcony and also the patio and pool below. The construction of these enclosures utilize primary components, such as beams and posts/columns and secondary components such as purlins and other profiles which serve to brace and stabilize the beams and posts/columns when connected to each other. There are purlins, beams, posts and profiles that are commercially available in solid and hollow extruded forms. Conventional connectors, such as gusset plates, stud anchors, lags and self-tapping sheet metal screws are utilized in constructing an enclosure. The subject invention is concerned with the construction of the beams and posts/columns that are the primary structural members that carry the live loads of the enclosure and secondary members that provide additional support thereto with both the primary and secondary members having the capability of receiving exterior decorative inserts.

The enclosures are pre-measured, laid out, engineered and prefabricated in a shop in most instances. The wall panels are also pre-screened, however, the roof panels are screened on site. The entire pre-fabricated job is then assembled and erected and in most cases attached to the house structure.

As the projection from the fascia of the home to the back of the enclosure or patio area increases, so must the size of the beams and the uprights (posts/columns), depending on the height and span in order to carry the loads. By means of the present invention, applicant has developed a variable load system which can be used to incrementally increase the load carrying capacity of the beams and posts/columns depending on the design criteria of the job. Each of these components, i.e. the beam and post/column is comprised of a pair of U-shaped extruded aluminum members which are combined and secured to each other to form a hollow beam or post/column. These components have an inherent load capacity based upon the height, width and wall thickness of these members. The current way of increasing the structural strength of the load carrying beams and post/columns is to increase the overall dimensions of the beams and post/columns, resulting in a larger beam and posts/column. However, applicant has developed a unique U-shaped extruded profile which allows one to add additional material in the form of metallic inserts which increase the overall load carrying capacity of the beam or post/column while retaining the outside dimensions of the previously used beams and posts/columns. The newly designed members include provision for receiving metallic inserts in the interior wall portions of the U-shaped members for increasing their structural strength. The number of additional inserts can vary in number from one to four, depending upon the desired load carrying capacity requirements of the beam or post/column.

Additionally, applicant has provided a unique means for installing decorative inserts to the outside facing portions on the exterior of the beams and posts/columns to break-up the boredom of conventional bronze or white colored beams and posts/columns as is presently the case. These decorative inserts are available in a variety of colors which can be selected to match the window trim or interior decor of the pool/patio furnishings. In addition to a variety of colors, imitation wood grain, simulated stucco, and other surface finishes are also available. The subject matter of this application takes the decorative appeal of the enclosure to the next level by providing decorative inserts for the secondary members of the enclosure, i.e. the purlins, horizontal square members and base anchoring members that run along the floor. Thus, it can be seen that the subject invention provides almost limitless choices in outfitting one's screened enclosure.

DISCUSSION OF THE PRIOR ART

A search of the U.S. Patent Office files in the appropriate construction areas revealed the following patents:

U.S. Pat. No. 3,413,775—issued to Katz on Dec. 18, 1968 discloses a hollow building column 10 wherein tape members 22, 24 are utilized to secure substrates to the outer surface which have a decorative effect.

U.S. Pat. No. 3,745,734—issued to Davey et al on Jul. 17, 1983—discloses a joint structure for strip concealing members.

U.S. Pat. No. 5,904,022—issued to Zadak on May 18, 1999 discloses a post and beam construction which include grooves or recesses on the outer portions thereof for receiving cover members 16, 20, 22. The disclosure relates to a particular post construction that includes channel members for linear adjustment relative to the beams and further includes decorative covers is to improve the aesthetic appearance of the post and beam.

U.S. Pat. No. 3,416,282—issued to Daugherty on Dec. 17, 1968; U.S. Pat. No. 4,843,783—issued to Taravella on Jul. 4, 1988; and U.S. Pat. No. 5,088,253—issued to Autkeier on Feb. 8, 1992—These three patents disclose the use of trim strips which are received in grooves and used primarily for decorative purposes.

U.S. Pat. No. 5,203,130 issued to Freelove on Apr. 20, 1993

U.S. Pat. No. 5,737,878 issued o Rauleron et al on Apr. 14, 1998

U.S. Pat. No. 5,775,045 issued to Hill on Jul. 7, 1999

Each of these three patents disclose U-shaped members which are positioned over a door frame of jamb and serve as guards or shields to protect the frames against damage by wheelchairs, equipment and the like impacting upon them.

Although these patents disclose the use of decorative inserts on various building components including a post and beam, none disclose the use of U-shaped members which form a hollow beam wherein the inner walls of the beam or post/column receive metallic inserts to increase the structural strength thereof. Applicant's beams, secondary members and posts/columns further includes means for receiving decorative inserts to improve their appearance. It is urged that none of the above cited patents taken alone or in combinations thereof are anticipatory of the claimed subject matter hereinafter.

SUMMARY OF THE INVENTION

From the foregoing discussion it can readily be seen that applicant has provided a unique beam and post/column design that allows one to create a beam and post/column that will be job specific and aesthetically pleasing to one's eyes. Once the calculations have been made as to the particular job site, the fabricator can readily determine the number of metallic inserts required to satisfy the structural load requirements. With this system, the inventory of beams and posts/columns required by the fabricator is reduced to a minimum since the structural requirements can readily be satisfied by the addition of one or more stock metallic inserts, up to a maximum of four to vary the load capacity. Further, the provision of secondary members wherein decorative inserts are added, takes the enclosure's appearance to the next level.

Additionally, the subject invention provides for a wide selection of decorative inserts which can be readily installed without the need for special tools, clips or other hardware to the inner face portions of the posts/columns, beams and secondary members such as the purlins and base members that are anchored to the floor. After selection of the desired decorative style, one only needs to cut the vinyl or aluminum strip to its desired length and slide it into the channels, which are integrally formed on the exterior faces of the beams, posts/columns and secondary members.

OBJECTS OF THE INVENTION

An object of the invention is to provide a patio/pool enclosure which utilizes unique beam and post/column components in its construction.

A further object of the invention is to provide a screened enclosure that includes post/column components and secondary members that are provided with decorative inserts therein.

Another object of the invention is to provide a construction beam and post/column which includes means for varying its structural load capacity.

A further object of the invention is to provide a novel beam and post/column which reduces the inventory size required by a manufacturer.

Still another object of the invention is to provide a unique beam and post/column which can be incrementally strengthened through the selective addition of metallic inserts into the beam and post/column, Yet another object of the invention is to provide a patio and pool enclosure which can be pre-assembled into panels for subsequent installation at the job site.

Another object of the invention is to provide a unique patio enclosure with construction beams and posts/columns that include integrally formed channels for receiving screening fabric and decorative inserts.

Yet another object of the invention is to provide a screened patio or patio/pool enclosure that becomes an integral outdoor extension of the home thus providing insect-free enjoyment to the homeowner.

A still further object of the invention is to provide the secondary support members with means for receiving screening fabric and decorative inserts to further enhance the overall aesthetic appearance of the enclosure.

These and other objects of the invention will become more apparent hereinafter. The instant invention will now be described with particular reference to the accompanying drawings that form a part of this specification wherein like reference characters designate the corresponding parts in the several views.

DETAILED DESCRIPTION OF THE DRAWINGS

Figure 1:
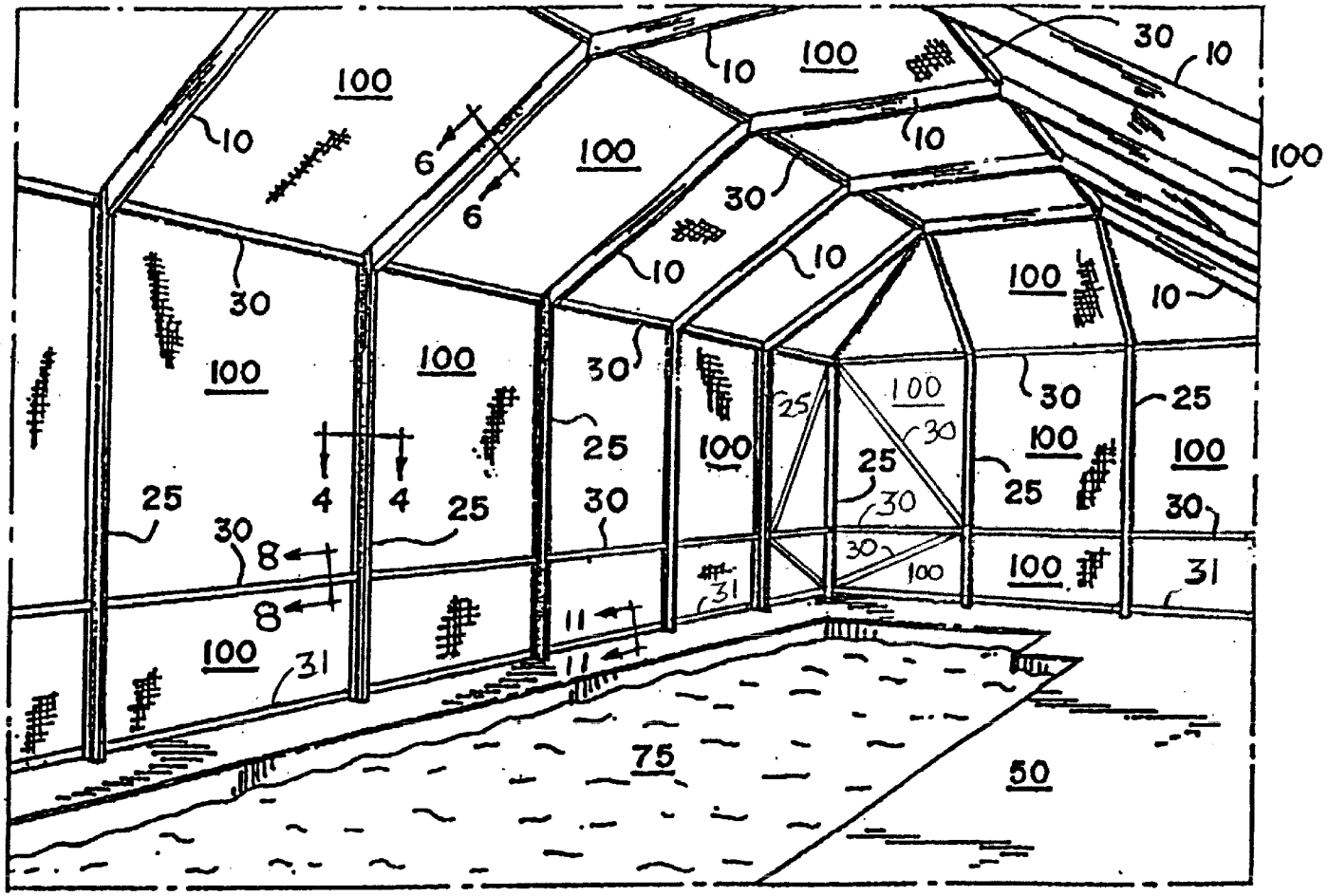
FIG. 1 is a perspective view of a screened patio and pool enclosure showing the novel beams and posts/columns with their secondary members in position for supporting the enclosure structure.

Referring to FIG. 1, there is illustrated a perspective view of a screened pool and patio enclosure 200 utilizing the novel beam and posts/column construction members of the subject invention to enclose a patio 50 and pool 75. There is shown a plurality of screening panels 100 which include fiberglass screening attached in the usual manner to the beams 10 and post/columns 25 with a plurality of purlins 30 interconnecting beams 10 and posts/columns 25 to provide stability and lateral support to the enclosure 200. Purlins 30 are commercially available aluminum components available in either hollow or solid form measuring approximately 1×2 inches and 2×2 inches in cross-section. As shown, beams 10 are the diagonal and horizontal upper structural members while the posts/columns 25 provide the vertical support to enclosure 200. Beams and posts/columns are available in a variety of sizes ranging from 2×4 through 2×10 inches. The terms post/column refers to the vertical supports 25 which are sometimes referred to as "posts" and of columns". However, it is intended that the terms "posts" and to columns" are, in fact, the same component and can be used interchangeably. Also shown are base anchor members 31 that are anchored to the patio deck 50. Base members 31 extend the full perimeter of the enclosure and serve to provide attachment means for the lowermost screen panels 100 where it meets the deck 50.

Figures 2, 3:
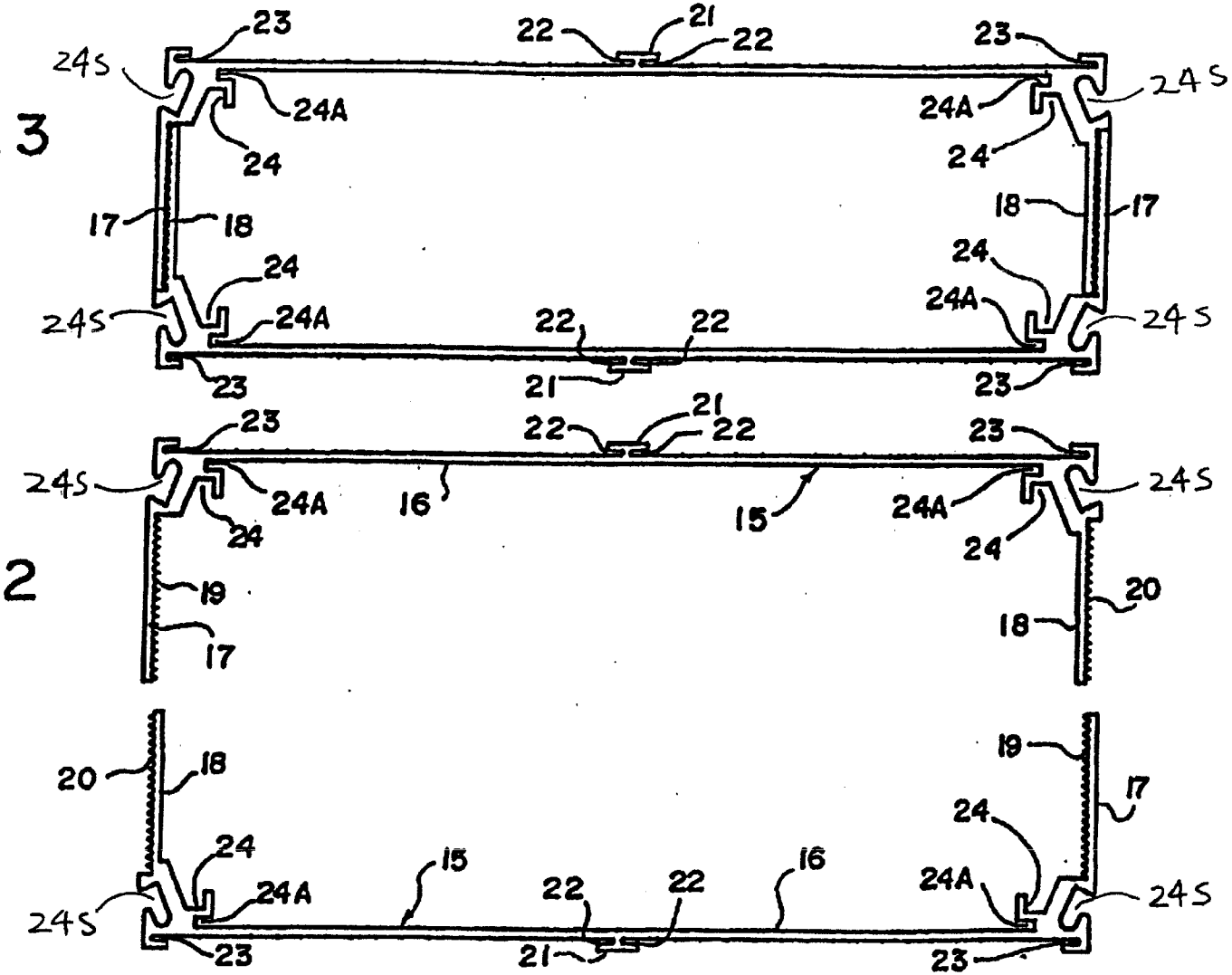
FIG. 2 is an illustration of a first embodiment of the novel U-shaped component used for the insertion of plural decorative and metallic inserts.
FIG. 3 illustrates the two U-shaped components joined together to form the hollow beam and post/column.

Turning now to FIG. 2, there is shown the two U-shaped components 15, which when united, form the hollow beams 10 and posts/columns 25. The beams 10 and posts/columns 25 are constructed of two U-shaped extruded aluminum components 15 which are identical to each other. In FIG. 2, the lower U-shaped component 15 is merely rotated 180 degrees relative to the upper U-shaped component 15. Each U-shaped component 15 comprises a horizontal mid-portion 16 with a pair of legs 17 and 18 extending downward from opposite ends thereof a short distance. Leg 17 is provided with inside ridges 19 while leg 18 has outer ridges 20 thereon. Centrally located on the outer surface of mid-portion 16 is divider 21. Divider 21 includes a pair of oppositely disposed recesses 22 which cooperate with recesses 23 on the opposite ends of mid-portion 16 to receive decorative inserts, not shown in this view. U-shaped components 15 also include two pair of oppositely disposed recesses 24, 24A at the inner corners thereof for receiving metallic inserts therein. Additionally, each U-shaped component 15 is provided with a pair of spline grooves 24S. Spline grooves 24S receive the screening fabric and is retained therein by a flexible vinyl or rubber-like retaining strip that is forced into spline grooves 24S over the screening fabric.

FIG. 3 illustrates the U-shaped members 15 of FIG. 2 in their mated condition, this is accomplished by merely sliding legs 17 and 18 of one U-shaped member 15 over legs 17 and 18 of the other U-shaped member 15, as shown, inner and outer ridges 19, 20 cooperate to securely hold U-shaped components 15 firmly together to form a hollow beam or post/column. A plurality of self-tapping screws are inserted at spaced intervals from the outside through and into legs 17 and 18 to insure structural integrity of the unit.

Figure 4:
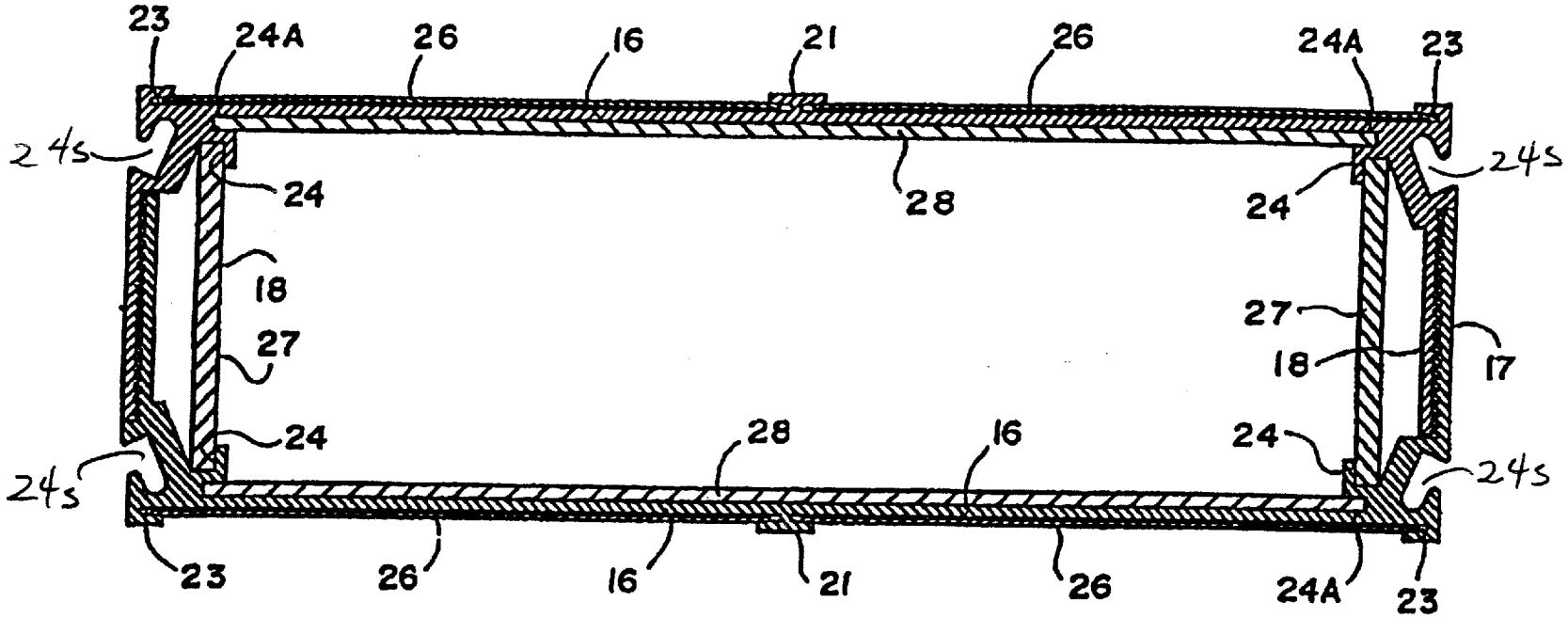
FIG. 4 is sectional view taken along the plane 4—4 of FIG. 1 illustrating the first embodiment of the novel beam and post/column with the metallic and decorative inserts placed therein.

Referring now to FIG. 4, there is shown a sectional view taken along the plane 4—4 of FIG. 1, illustrating a completed post/column 25 with a pair of decorative inserts 26 installed on each mid portion 16. Additionally, metallic inserts 27 have been installed in recesses 24 with additional metallic inserts 28 installed in recesses 24A. Inserts 27 and 28 are made of aluminum bar stock material with inserts 27 shown thicker than inserts 28 The specific dimensions of these members may vary as required for a particular job.

Figure 6:
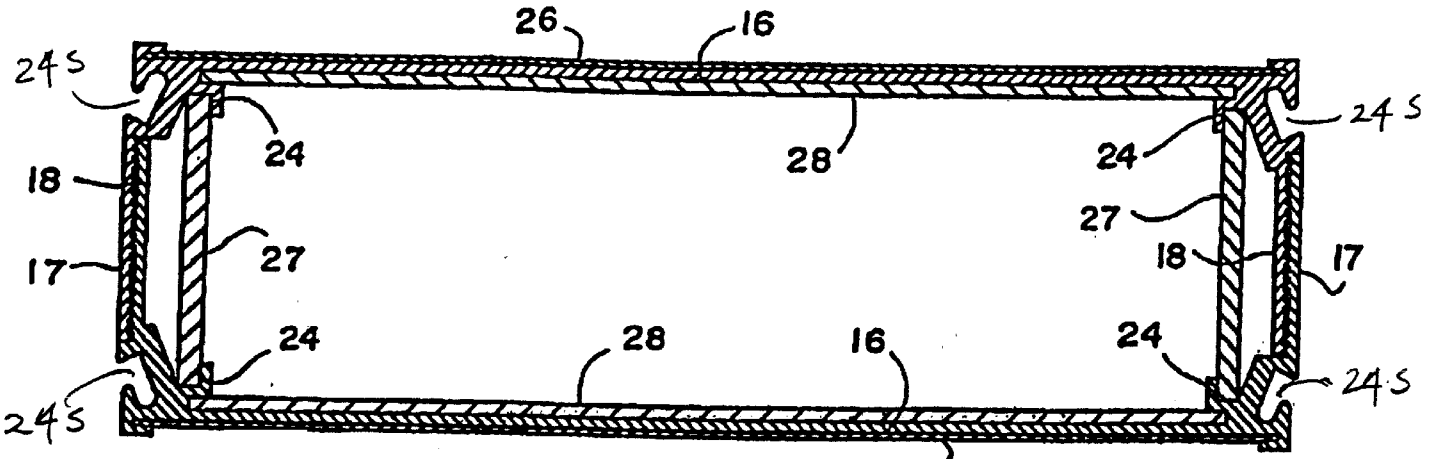
FIG. 6 illustrates a sectional view taken along the plane 6—6 of FIG. 1, illustrating the second embodiment wherein a single decorative insert is utilized on two sides of the beam and post/column.
Figure 5:
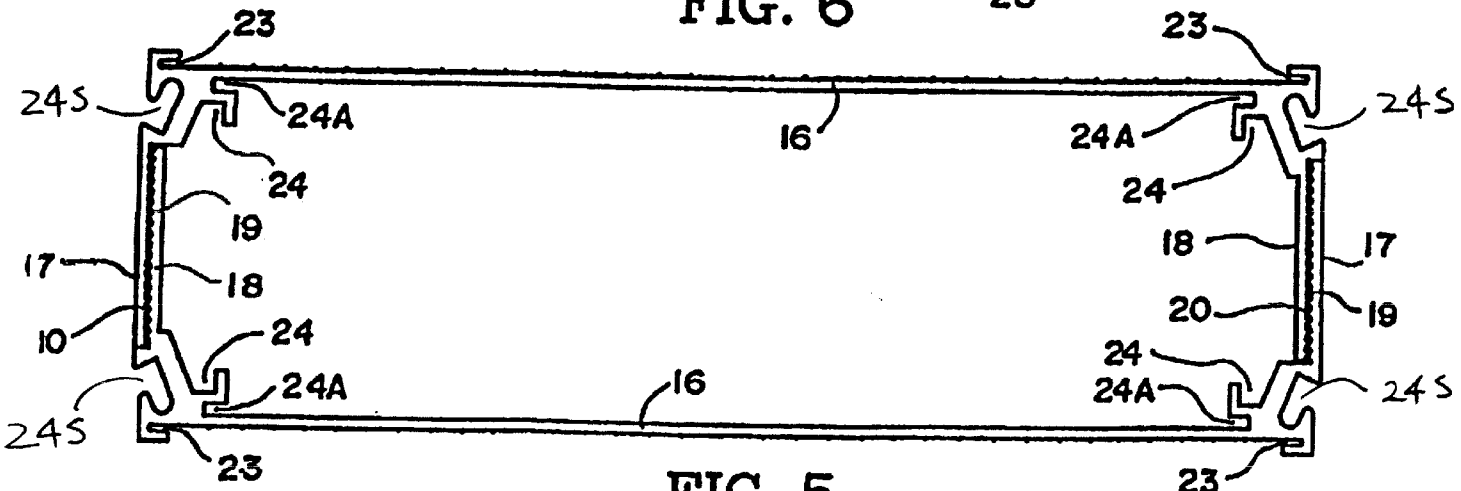
FIG. 5 illustrates the second embodiment of the novel U-shaped components joined together and illustrating their condition prior to insertion of any decorative or metallic reinforcement inserts therein.

Referring now to FIG. 5, there is shown another embodiment of the novel beam and post/column construction. This embodiment is identical to the first embodiment shown in FIG. 3, with one exception, divider 21 has been deleted. Without divider 21 a single decorative insert, extending the full width of mid-portion 16 can be inserted therein, thus giving the homeowner an additional choice as to whether a single or double decorative insert should be used, FIG. 6 is a sectional view taken along the plane 6—6 of FIG. 1, illustrating the assembled beam 10 with the four metallic inserts 27,27 and 28,28 inserted into their respective recesses for added structural strength. Additionally, a pair of decorative inserts have been placed in their respective recesses 23. The decorative variations of FIGS. 4 and 6 may be reversed or optionally, the decorative inserts of both the beam and post/column may be comprised of a single decorative insert 26 as in FIG. 6 or alternatively, both the beam and post/column may comprise plural decorative inserts as shown in FIG. 4.

Figure 7:
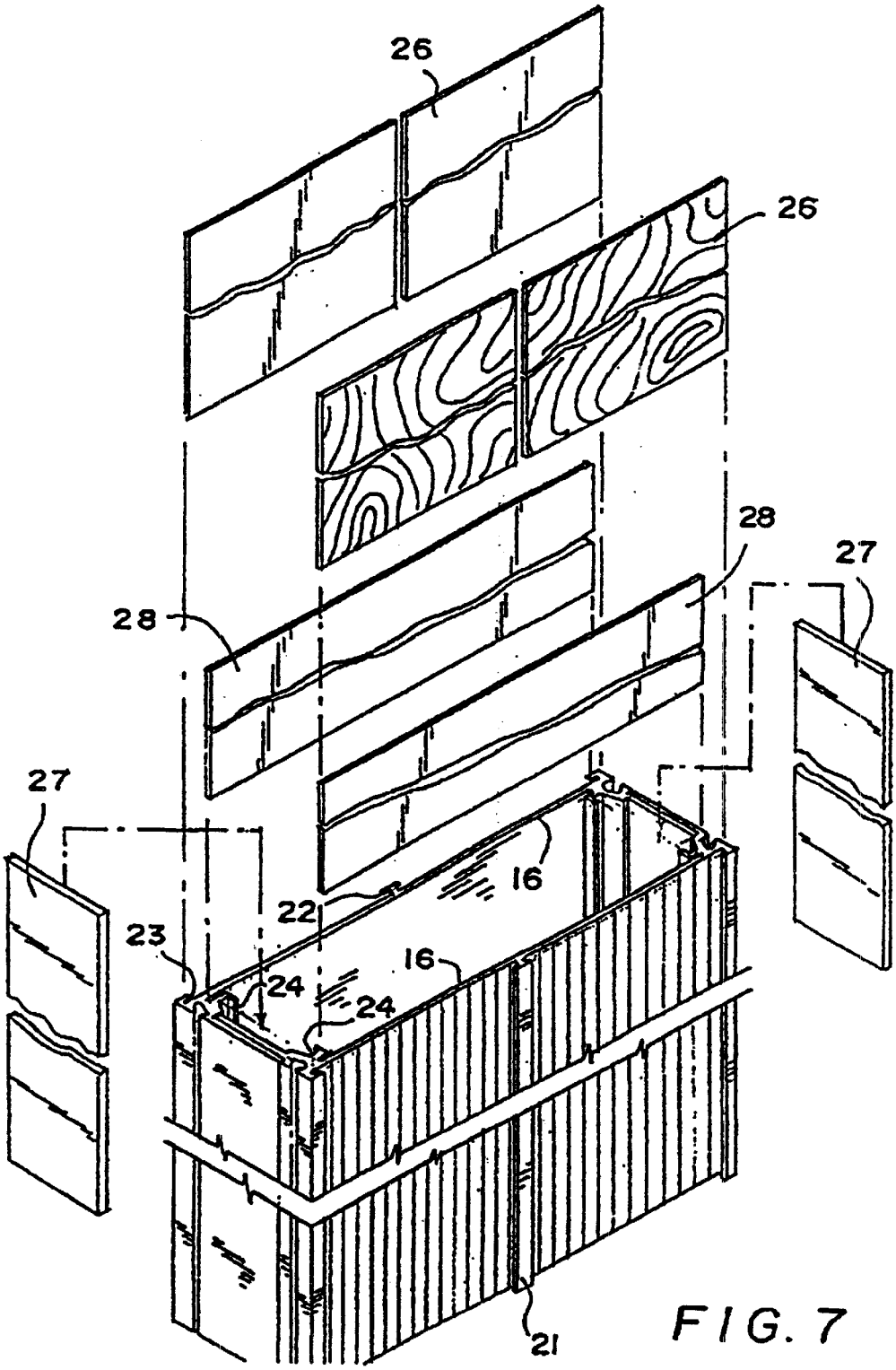
FIG. 7 is an exploded view of the unique beam and post/column illustrating the first embodiment and the manner of inserting the decorative and metallic inserts.

Turning now to FIG. 7, there is illustrated an exploded view of the FIG. 4 embodiment showing the metallic inserts 27,28, which are preferably made of aluminum, prior to insertion. Decorative inserts 26, with a simulated wood grain finish thereon are shown in alignment with recesses 22 and 23 about to be inserted therein. Additionally the inserts are shown in their relative positions prior to insertion into their respective recesses.

Figure 8:
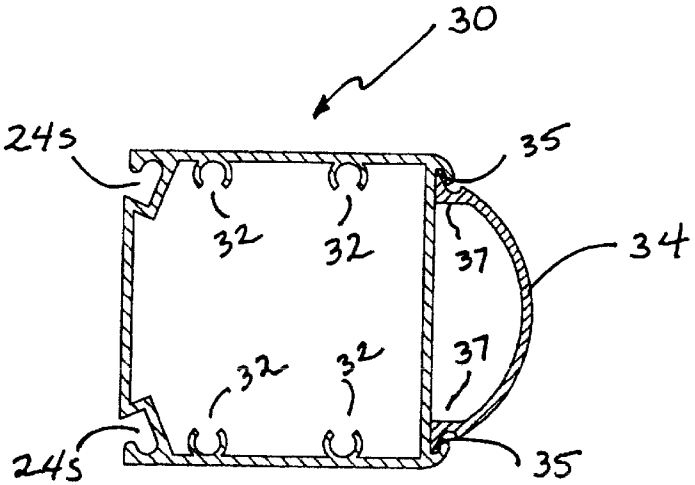
FIG. 8 is a sectional view, taken along the plane 8—8 of FIG. 1, illustrating a novel square secondary horizontal member that is provided with recesses for receiving screening fabric and a decorative pinstripe inserted in the opposite side thereof.

Referring to FIG. 8, there is shown a cross-sectional view, taken along the plane 8—8 of FIG. 1, illustrating the purlin or horizontal support member 30. Purlin 30 is a secondary member of extruded aluminum having a hollow square configuration with a first pair of oppositely disposed recesses or grooves 24S for receiving the screening fabric therein. At the opposite side is a second pair of oppositely disposed grooves or recesses 35 with decorative pinstripe insert 34 mounted therein. Located internally, within the hollow portion thereof, are a plurality of screw bosses 32 that are used for receiving screws, for example, where the end abuts a vertical post/column. As indicated above, insert 34 may be vinyl, aluminum or other suitable flexible material.

Figure 9:
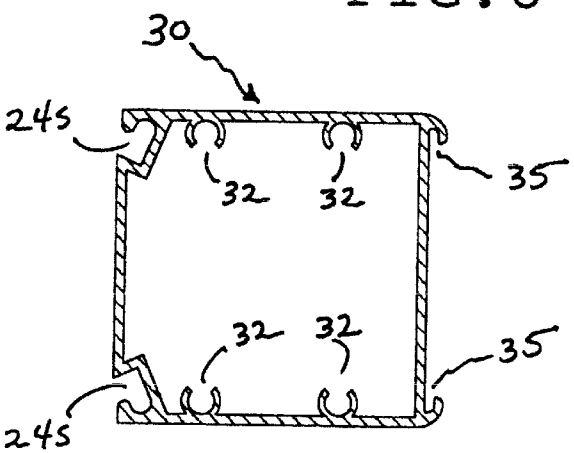
FIG. 9 is a sectional view of the secondary member of FIG. 8, illustrating the secondary member per se, with the vinyl pinstripe and screening fabric receiving grooves/recesses therein.

Referring to FIG. 9, there is shown a cross-section of horizontal support member 30, per se, that is used for lateral support between the vertical posts/columns 25 and beams 10. As indicated, oppositely disposed recesses 35 include an inwardly turned portion for receiving retaining legs 37 of decorative insert member 34.

Figure 10:
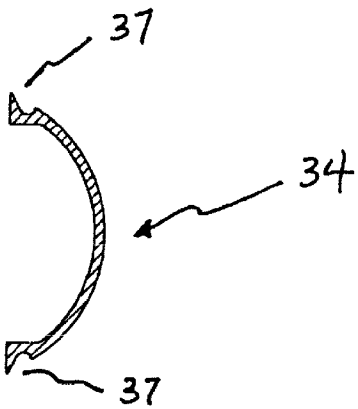
FIG. 10 is an illustration of the decorative insert, per se, that is used in conjunction with the square secondary member profile of FIG. 9.

Referring to FIG. 10, there is shown decorative pinstripe insert 34, per se, that is available in a variety of colors to suit the taste of the homeowner. As shown, pinstripe insert 34 is an extruded flexible arcuate member with a pair of retaining legs 37 at the ends thereof that are received in grooves or recesses 35. Inserts 34 are merely squeezed at opposite ends 37, and released into recesses 35 where they are retained due to their flexibility. Decorative inserts 34 can be made of extruded vinyl, aluminum or other suitable flexible material.

Figure 11:
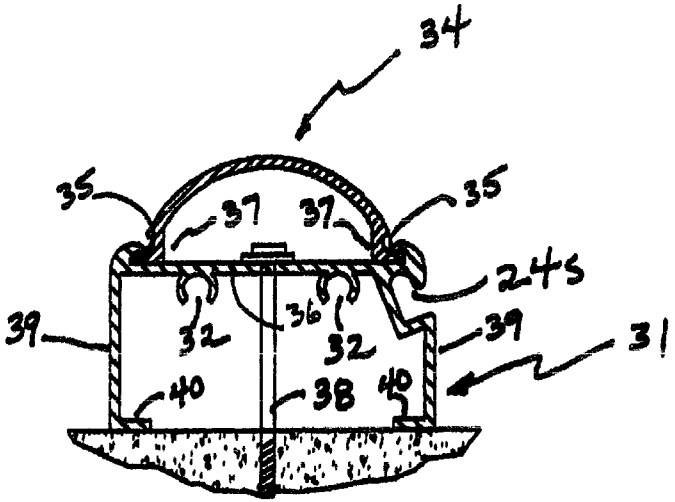
FIG. 11 is a cross sectional view, taken along the plane 11—11 of FIG. 1, illustrating another secondary member, a base anchor member for securing the lowermost panel of screening.

Referring now to FIG. 11, there is shown a cross-sectional view, taken along the plane 11—11 of FIG. 11, illustrating another secondary member 31 that runs along the floor and supports the lowermost panel of screening fabric 100 and also provides lateral support to adjacent post/columns 25. As shown, secondary member 31 is anchored to the floor by lag bolt 38 that is inserted through mid-portion 36 of secondary member 31 to anchor member 31 to the floor.

Figure 12:
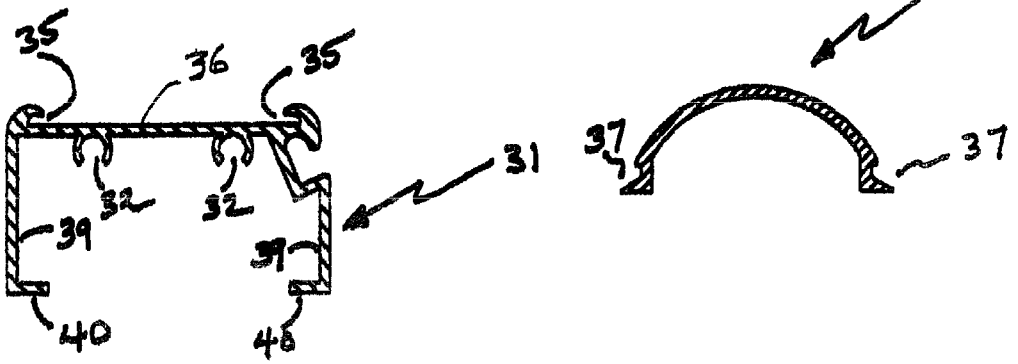
FIG. 12 is a cross-section of the base anchor member of FIG. 11 without the vinyl pinstripe mounted therein.

FIG. 12 is an illustration of secondary member 31, per se, as shown, it is an aluminum extruded member with oppositely disposed recesses 35 for receiving decorative insert 34 and a screening retaining groove 24S, both of which are formed in the extrusion process. It further includes a mid-portion 36 and a pair of spaced depending legs 39 with inwardly turned ends 40 for engagement with a supporting surface.

Figure 13:
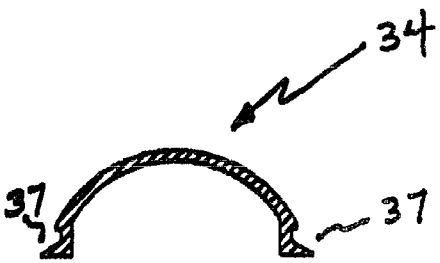
FIG. 13 is a cross-sectional view of the pinstripe, per se, illustrated in FIG. 11.

FIG. 13 is an illustration of pinstripe insert 34 per se. As shown, it has an arcuate portion terminating in a pair of retaining legs 37 for engagement with recesses 35.

Figure 14:
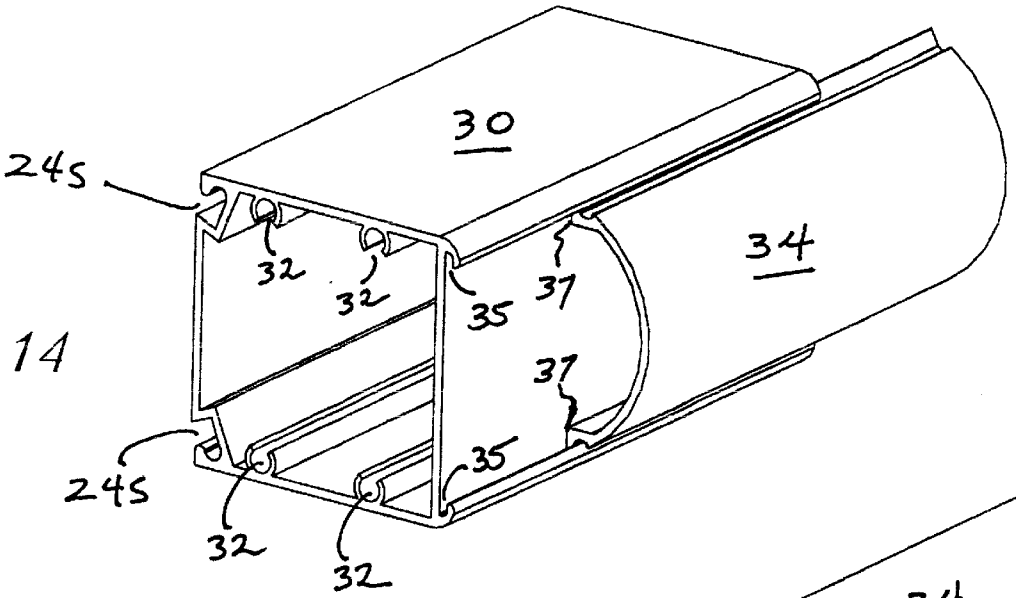
FIG. 14 is an enlarged perspective view of a square secondary member illustrating the pinstripe vinyl insert partially inserted therein.

FIG. 14 is an enlarged perspective view showing the same structure of FIG. 8, illustrating the manner of insertion of decorative insert member 34 into secondary member 30.

Figure 15:
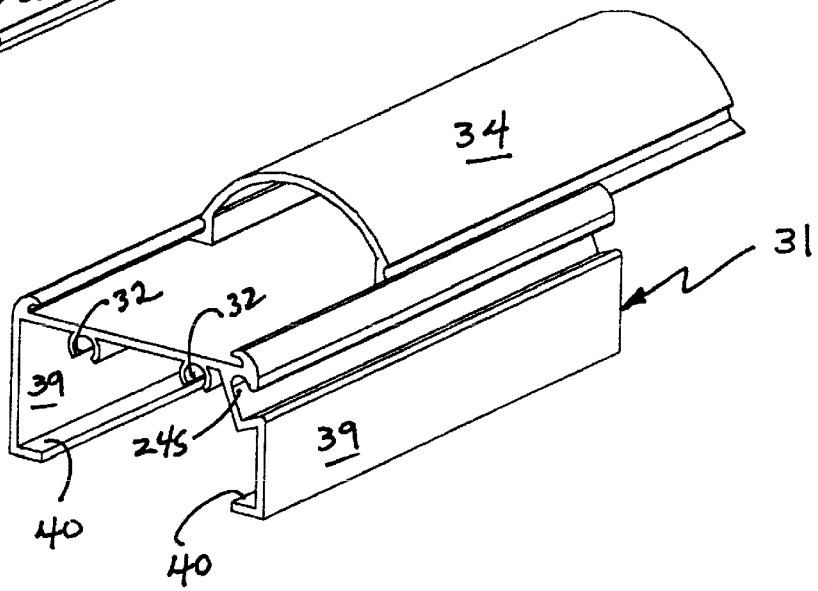
FIG. 15 is an enlarged perspective view of the base anchor member with the pinstripe vinyl insert partially inserted therein.

FIG. 15 is an enlarged perspective view showing the same structure of FIG. 11, illustrating the manner of inserting decorative insert 34 into secondary anchor member 31.

By way of review, it is pointed out that applicant has provided a unique hollow beam and post/column construction that includes means for varying its structural load capacity by the insertion of additional load carrying members. As indicated earlier, these load carrying inserts are common aluminum flat bar stock material that are received in the interior of the beam 10 and post/column 25. The number of inserts varies, depending upon the load requirements of the particular job. Additionally, applicant has provided a beam and post/column construction that allows receiving a variety of decorative inserts, thus adding to the interior beauty of the enclosure. Finally, applicant has provided a means for further improving the aesthetic appearance of the enclosure by providing decorative inserts for the secondary members, thus raising the appearance appeal to the next level.

While the invention has been described in its preferred embodiments, it is to be understood that the words used herein are words of description rather than words of limitation and that changes may be made within the purview of the appended claims without departing from the full scope or spirit of the invention.

Having thus described my invention, I claim:

1. A screened patio enclosure including in combination:

a plurality of primary variable capacity load bearing members;

said variable capacity load bearing members including vertical and diagonal members;

a plurality of secondary support members interconnected with said primary variable capacity load bearing members for providing additional stability to the overall enclosure;

said primary and secondary members are provided with means for receiving and retaining screening fabric on exterior portions thereof;

said primary load bearing members including internal oppositely disposed recess means for receiving strengthening members and varying the load carrying capacity of said members and also decorative inserts in an end opposite to said screening fabric receiving portion thereof;

said primary load bearing members further including a pair of centrally located outer mid-portions forming a divider with oppositely disposed recesses for receiving additional decorative insert means therein for changing the aesthetic appearance of the enclosure;

said secondary members also including decorative means for further improving the aesthetic appearance of the enclosure whereby said primary and secondary members can be used together to provide a warm appearance to the interior of said screened enclosure.

2. A screened patio enclosure of the character defined in claim 1 wherein said primary and secondary members are provided with means for receiving and retaining said decorative inserts on interior portions thereof.

3. A screened patio enclosure of the character defined in claim 2 wherein said decorative inserts are made of flexible vinyl and available in a variety of colors.

4. A screened patio enclosure of the character defined in claim 2 wherein said decorative inserts are made of aluminum and available in a variety of colors.

5. A screened patio enclosure of the character defined in claim 2 wherein said primary load bearing members are posts and columns.

6. A screened patio enclosure of the character defined in claim 2 wherein said primary load bearing members are beams.

7. A screened patio enclosure of the character defined in claim 2 wherein said secondary members are purlins for providing lateral support to said primary load bearing members.

8. A screened patio enclosure of the character defined in claim 2 wherein said secondary members are base anchoring members secured to the floor of the enclosure.

9. A screened patio enclosure of the character defined in claim 7 wherein said purlins are square hollow aluminum extrusions with screen retaining recesses and decorative insert retaining recesses provided at opposite sides thereof.

10. A screened patio enclosure of the character defined in claim 8 wherein said base anchoring members are aluminum extrusions with a pair of oppositely disposed decorative insert receiving recesses and a screening receiving groove located near one of said decorative insert receiving recesses.

11. A screened patio enclosure of the character defined in claim 9 wherein vinyl decorative inserts are inserted into said decorative receiving recesses.

12. A screened patio enclosure of the character defined in claim 9 wherein aluminum decorative inserts are inserted into said decorative receiving recesses.

13. A screened patio enclosure of the character defined in claim 10 wherein decorative vinyl inserts are inserted into said decorative receiving recesses.

14. A screened patio enclosure of the character defined in claim 10 wherein decorative aluminum inserts are inserted in said decorative receiving recesses.

* * * * *